US006293718B1

(12) United States Patent
Osmus

(10) Patent No.: US 6,293,718 B1
(45) Date of Patent: Sep. 25, 2001

(54) PRINTER WITH A TWO ROLLER, TWO MOTOR PAPER DELIVERY SYSTEM

(75) Inventor: James M. Osmus, Escondido, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/478,190

(22) Filed: Jan. 5, 2000

(51) Int. Cl.[7] ..... B41J 11/58
(52) U.S. Cl. ..... 400/625; 400/629; 347/104
(58) Field of Search ..... 400/624, 625, 400/629; 399/78; 37/104, 31, 36; 271/10.03, 117

(56) References Cited

U.S. PATENT DOCUMENTS 4,270,860 * 6/1981 Tsuda et al. ..... 399/78
5,223,858 * 6/1993 Yokoi et al. ..... 347/104
5,462,373 * 10/1995 Chia ..... 400/624
5,500,659 * 3/1996 Curran et al. ..... 347/31
5,598,201 * 1/1997 Studder et al. ..... 347/104
5,720,477 * 2/1998 Morita et al. ..... 271/117
5,772,343 * 6/1998 Beretta et al. ..... 400/624
5,997,128 * 12/1999 Lou et al. ..... 347/36
6,074,055 * 6/2000 Myung ..... 347/104
6,105,954 * 8/2000 Magee et al. ..... 271/10.03
6,132,122 * 10/2000 Robinson et al. ..... 400/624
6,172,691 * 1/2001 Belon et al. ..... 347/104

* cited by examiner

*Primary Examiner*—Eugene Eickholt

(57) ABSTRACT

The present invention is embodied in a low-profile and narrow-width printer that has two rollers, a pick roller and a feed roller, and two roller motors. Each one of the two roller motors is used to drive one of the two rollers. As a result, a short gear train can be used to allow a longer paper path for enabling a low height printer. Also, a print media can be picked up from the input tray while another print media is being printed upon by an ink jet printhead or printhead. Thus, throughput of the printer can be enhanced when the printer is printing a multi-page document. Further, the printer straightens out print media that are skewed when picked up by the pick roller. Finally, the printer is able to locate a paper jam by using two sensors, one by the pick roller and the other by the feed roller.

20 Claims, 5 Drawing Sheets

PRINTER WITH A TWO ROLLER, TWO MOTOR PAPER DELIVERY SYSTEM

CROSS REFERENCE TO RELATED APPLICATIONS

This application is related to the following copending utility patent applications, each filed concurrently on Jan. 5, 2000: Ser. No. 09/477,645 by Ram Santhanam et al., entitled "Vent For An Ink-Jet Print Cartridge"; Ser. No.: 09/477,646, which issued on May 5, 2001 as U.S. Pat. No. 6,227,663 by Ram Santhanam et al., entitled "Ink-Jet Print Cartridge Having A Low Profile"; Ser. No.: 09/477,644 by Junji Yamamoto et al., entitled "Horizontally Loadable Carriage For An Ink-Jet Printer"; Ser. No.: 09/477,649 by Junji Yamamoto et al., entitled "Method And Apparatus For Horizontally Loading And Unloading An Ink-Jet Print Cartridge From A Carriage"; Ser. No.: 09/478,148 by Richard A. Becker et al., entitled "Techniques For Providing Ink-Jet Cartridges With A Universal Body Structure"; Ser. No.: 09/477,843 which issued on Dec. 19, 2000 as U.S. Pat. No. 6,161,920 by Ram Santhanam et al., entitled "Techniques For Adapting A Small Form Factor Ink-Jet Cartridge For Use In A Carriage Sized For A Large Form Factor Cartridge"; Ser. No.: 09/477,860 by Keng Leong Ng, entitled "Low Height Inkjet Service Station"; Ser. No.: 09/477,648 by Matt Shepherd et al., entitled "New Method Of Propelling An Inkjet Printer Carriage"; Ser. No.: 29/116,564, which issued on Apr. 3, 2001 as U.S. Design Pat. No. D439,925 by Ram Santhanam et al., entitled "Ink Jet Print Cartridge"; and Ser. No.: 09/477,940 by Ram Santhanam et al., entitled "Multiple Bit Matrix Configuration For Key-Latched Printheads", all of which are incorporated by reference.

BACKGROUND OF THE INVENTION

1. Field of the Invention

The invention relates generally to printers, and more particularly, to an ink jet printer having two motors, each driving one of two sets of rollers of a drive paper mechanism.

2. Related Art

Digital set-top boxes (e.g., cable television boxes, Internet terminal boxes etc.) are being used increasingly with consumer home entertainment equipment such as television sets, video cassette recorders, digital video disc (DVD) players and the like. In many cases, it may be desirable for users to obtain a hard copy of information displayed on the screen of their television sets. Specifically, users typically want to print e-mail messages, maps, recipes and information-rich content, such as still or captured scenes from live broadcasts, DVD players, movie cameras, video recorders etc.

Currently, if a user wants to have a hardcopy of the displayed information, the user has to use a conventional printer. Most conventional printers, however, are bulky, and thus require large amounts of space in users' home entertainment units. Hence, a printer specifically designed for use in home entertainment units is needed (i.e., a living room printer).

The living room printer should be of low height (i.e., low profile) and relatively narrow in width to blend in with other home entertainment equipment. In addition, since home entertainment equipment is usually stacked one atop another in home entertainment units, user access to the living room printer should preferably be through a front plane of the printer.

Designing a low profile, narrow width printer with user front plane access presents some technical difficulties. For example, some conventional ink jet printers use a two-roller paper drive mechanism. One roller (i.e., a pick roller) is used to pick print media from an input paper tray and to propel the print media to a second roller (i.e., a feed roller). The feed roller forwards the print media to a print zone where the print media is printed upon by an ink jet printhead. For ease of explanation, the channel within which the print media travels from the pick roller to the print zone will be referred to as a paper path.

The feed roller is typically placed in close proximity to the print zone. This configuration minimizes paper advance errors. Paper advance errors occur when one part of the print media (the part in the print zone) moves slower than another part of the print media (the part closest to the feed roller). One reason for this occurrence is due to a combination of print media flexibility, inertia and a friction force that develops as the print media moves along the paper path. This friction force acts in opposite direction to the direction of travel of the print media. As such, paper advance errors typically occur more frequently with increased distances between the print zone and the feed roller. Thus, placing the feed roller close to the print zone diminishes the likelihood of paper advance errors.

When a print media is skewed (i.e., when the print media is at an angle greater than zero degree in relation to the paper path) as it is picked up by the pick roller, it usually remains skewed as it reaches the print zone, thereby creating a slanted printout. In addition, both right and left margins of the print media may be offset. The extent to which the margins will be offset depends on the length of the paper path and the angle at which the print media is picked up by the pick roller.

Consequently, typical printers are designed to have a short paper path to minimize the offset of the margins of a skewed print media. However, since low-profile living room printers require front access and have stringent height requirements, a short paper path is undesirable. As such, current low-profile printers require longer paper paths, which necessitate longer gear trains to drive the rollers. A longer gear train increases the complexity of the paper drive mechanism. For example, if the teeth of one gear do not perfectly mesh with the teeth of another gear from which power is being transferred, a delay may be introduced. The delay will be equal to the elapsed time between when the motor is actuated and when the roller actually begins to move. Additional gears in the gear train equate to longer delays.

Although high precision gear trains are typically used to avoid this problem (a high precision gear train is a gear train that has the teeth of one gear that tightly interlocks with the teeth of another gear from which it receives power), they increase the complexity of assembling the paper drive mechanism of the printer which in turn increases the cost of the printer.

Therefore what is needed is a living room printer with a longer paper path that utilizes an efficient gear train. What is also needed is a printer with a gear train that has a low number of gears to transfer power from the motor to both the pick roller and the feed roller for reducing the complexity of assembling the paper drive mechanism without significantly reducing printer throughput.

SUMMARY OF THE INVENTION

To overcome the limitations of the systems and methods described above, and to overcome other limitations that will become apparent upon reading and understanding the present specification, the present invention is embodied in a low-profile and narrow-width printer having two rollers, a pick roller and a feed roller, and two roller motors. Each one of the two roller motors is used to drive one of the two rollers. Due to this configuration, a very short gear train can be used. For example, only two gears can be used to drive each one of the rollers, one from a motor and one from a roller.

Driving the pick roller by one motor and the feed roller by another motor allows the pick roller to pick a print media from the input tray while another print media is being printed upon by the ink jet printhead. This, then, minimizes the delay that normally occurs between two pages when a multi-page document is being printed, and thus, enhances the throughput of the printer.

Another advantage of having the two rollers driven by different motors is that skewed print media may be straightened out. The feed roller of the printer of the present invention is placed at a distance away from the pick roller that is chosen to be less than the length of the print media. When the leading edge of the print media reaches the feed roller, the feed roller is stationary. Thus, as the pick roller continues to push the print media forward, the print media is forced to form an arch. When the print media is arched, the leading edge of the print media is straightened out. Thus, when the motor driving the feed roller is actuated, the feed roller will forward a straightened print media to the print zone.

The printer of the present invention uses two sensors to pinpoint locations of paper jams. One sensor is preferably located near the pick roller and the other near the feed roller. If the sensor by the pick roller does not detect the print media after the print media is picked up by the pick roller, then there is a paper jam at the entrance of the paper path. If the sensor by the pick roller detects a print media but the sensor by the feed roller never detects the print media, then there is a paper jam in the paper path. If the sensor by the feed roller continues to detect the presence of the print media well after when the media should have cleared the print zone, there is a paper jam somewhere near or at the print zone. When it is detected that a paper jam exists either at the entrance of the paper path or in the paper path, the motor driving the pick roller is automatically run in reverse to clear the paper jam.

The present invention as well as a more complete understanding thereof will be made apparent from a study of the following detailed description of the invention in connection with the accompanying drawings and appended claims.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings, which form a part hereof, and in which is shown by way of illustration a specific embodiment in which the invention may be practiced. It is to be understood that other embodiments may be utilized and structural changes made without departing from the scope of the present invention.

Overview

Figure 1:
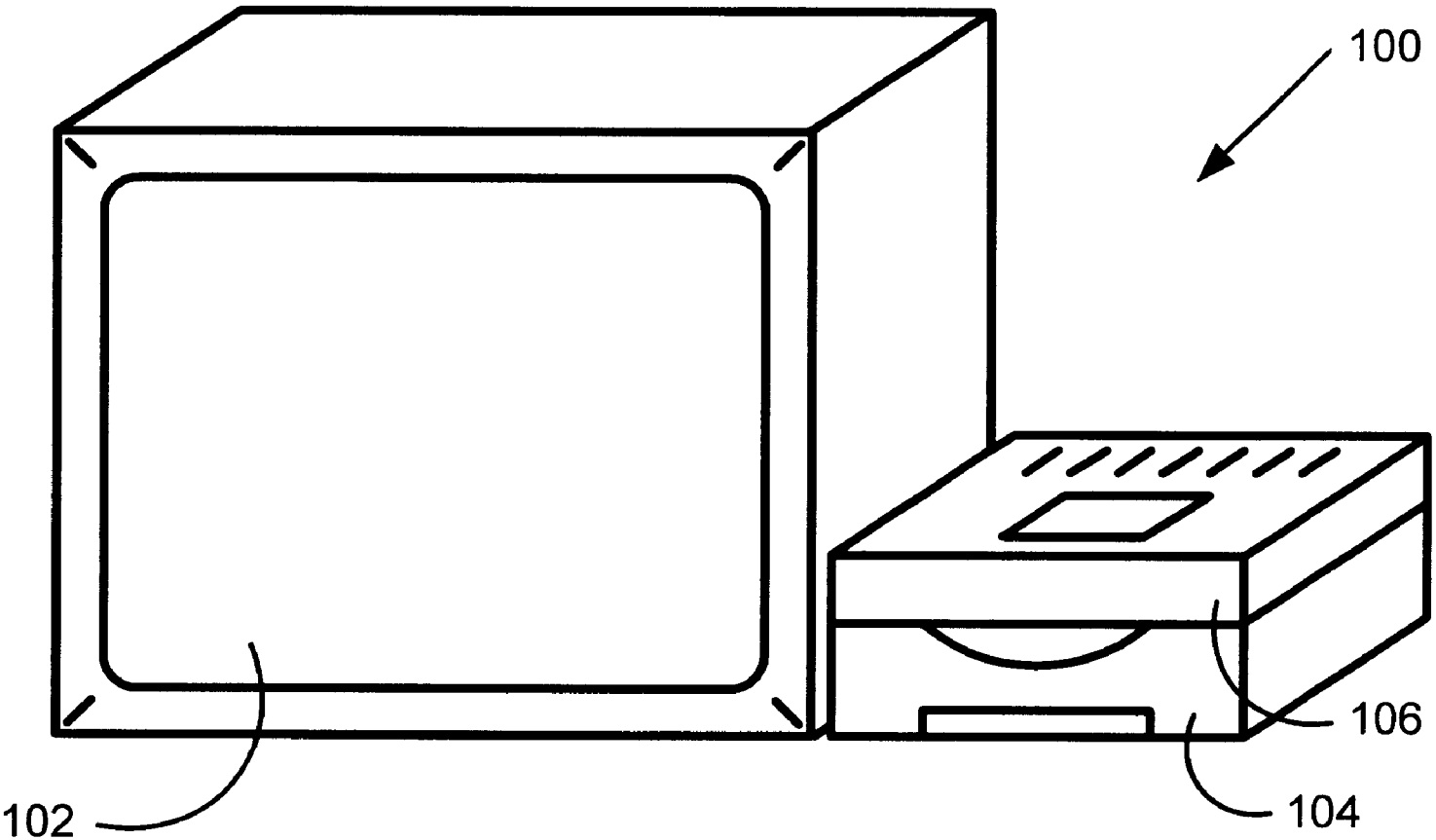
FIG. 1 depicts an overview diagram of a home entertainment system using the present invention.

As shown in the drawings for purposes of illustration, FIG. 1 depicts an overview block diagram of a home entertainment system 100 of the present invention. Namely, the system 100 includes a television set 102, a printer 104 (preferably suitable for entertainment systems or "living room" use) and a set-top box 106. The set-top box 106 can be located on top of the printer 104 which itself can be located on top of the television set 102. Although in FIG. 1 the set-top box 106 is shown atop the printer 104, the printer 104 can be placed in any suitable location, such as on top of the set-top box 106, without departing from the scope of the invention.

The set-top box 106 is electronically connected to the television set 102 via any suitable manner, such as a coaxial cable (not shown). The set-top box 106 is also connected to the printer 104 via a printer cable or ribbon (not shown). The set-top box 106 may contain at least a processor (not shown) to process data and a memory device (also not shown) to store bios and operating information and software programs, such as a printer driver. The set-top box 106 may also contain a connector or a suitable mechanism to communicate with other electronics, such as for downloading or updating software and firmware operating on the set-top box 106.

The present invention as shown in FIG. 1 solves problems that exist when a user desires a hard copy of the information displayed on the screen of the television set 102. Although conventional printers can be manually connected to some set-top boxes, most conventional printers are bulky, and thus require large amounts of space in users' home entertainment units. In addition, most conventional printers do not match the décor of entertainment equipment. The living room printer 106 in accordance with the present invention solves these problems.

Component Details and Operation

Figure 2:
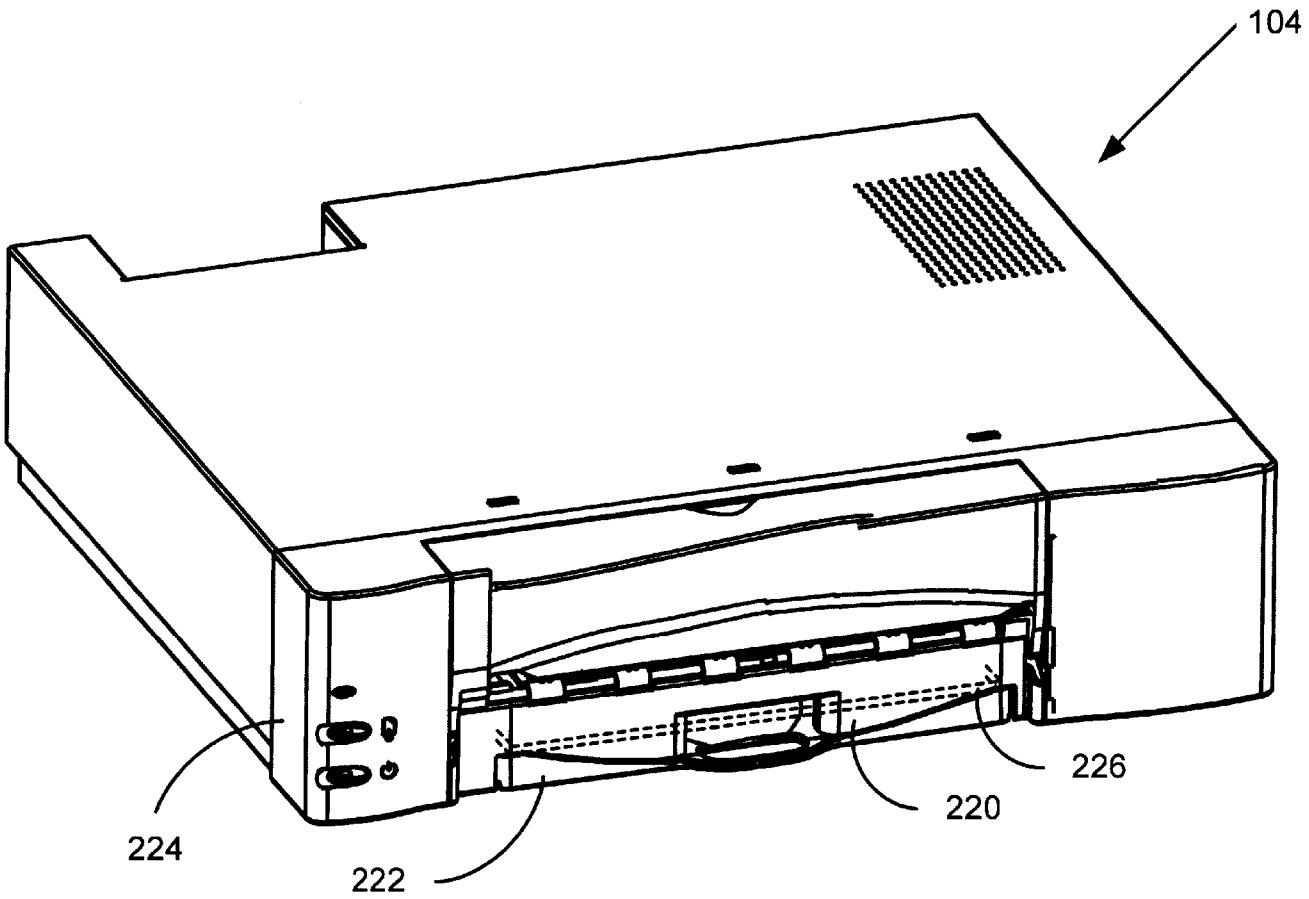
FIG. 2 illustrates a front view of the printer of the present invention.

FIG. 2 shows a front view of the printer of the present invention. The printer depicted in FIG. 2 is an exemplary printer and is shown for illustrative purposes only. Referring to FIG. 2 along with FIG. 1, the printer 104 includes input tray 220, an output tray 222, a status panel 224 with operating and status lights and function buttons, and print media 226 located within input tray 220. The input print media 226 can be loaded into the printer 104 by removing input tray 220, placing the input media 226 into the input tray 220 and reinserting the input tray 220 into the printer 104. The input tray 220 can also be removed to clear paper jams as well as to remove or replace ink jet printheads. Input tray 220 can be on slides, rollers or any other suitable device or combination thereof to facilitate its removal and reinsertion into the printer 104.

Figure 3:
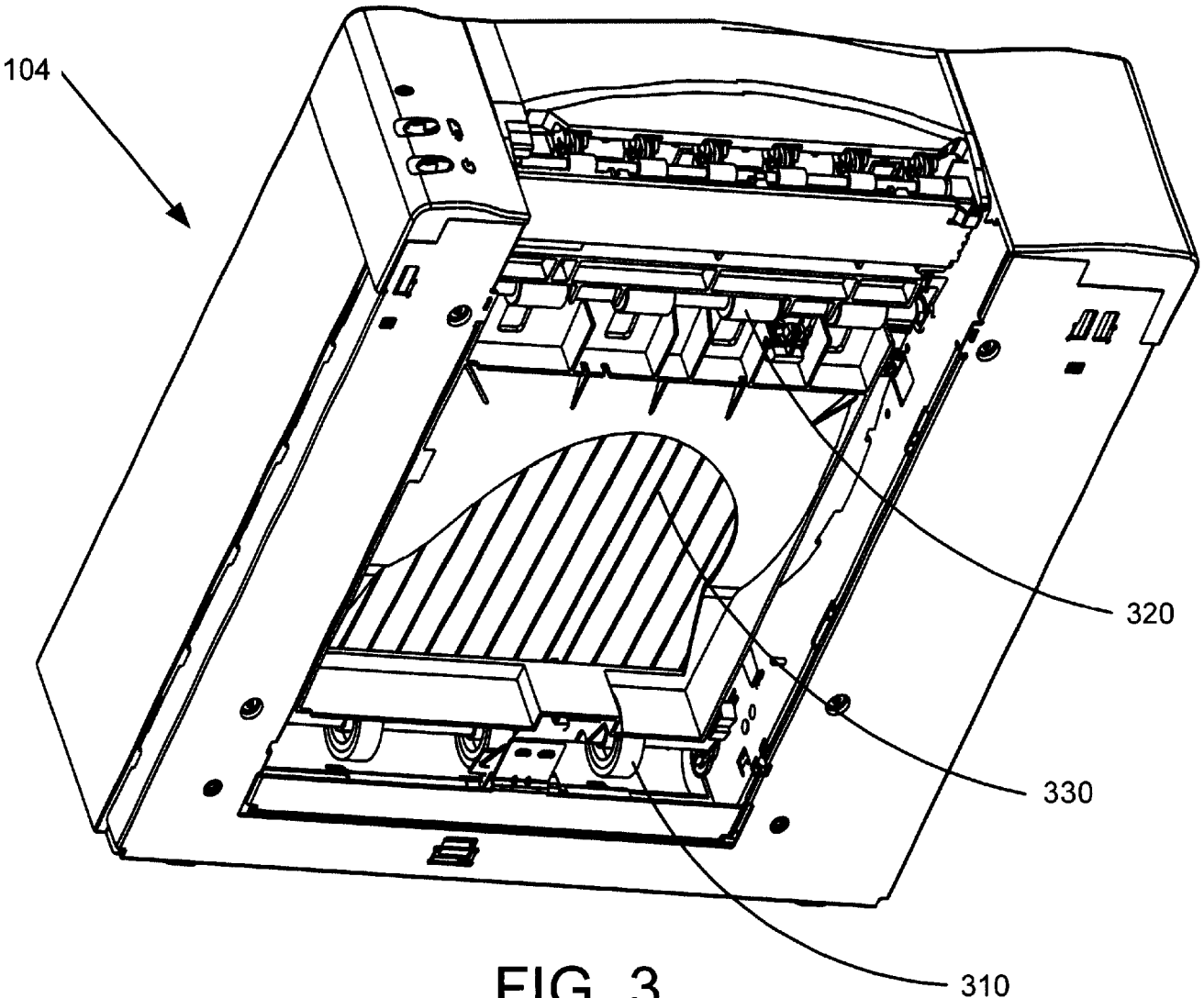
FIG. 3 depicts the printer of the present invention tilted upward.

FIG. 3 depicts the printer of the present invention in a tilted position. Referring to FIG. 3 along with FIG. 2, the input tray 220 and output tray 222 of FIG. 2 are removed to reveal a set of pick rollers 310, a set of feed rollers 320 and a media path 330. Pick rollers 310 are used to pick up the print media 226 from input tray 220 of FIG. 2, which would reside about the media path 330 in FIG. 3. One similar arrangement is disclosed in U.S. Pat. No. 5,466,079, issued to Quintana, and assigned to the current assignee, which is incorporated herein by reference, and is thus not disclosed further. The pick rollers 310 move the print media along media path 330 to feed rollers 320 which forward the print media 226 to a print zone (not shown) where the ink jet printhead (not shown) prints on the print media.

Since the height of the living room printer 104 of the present invention is minimized, a longer paper path is used with a novel relatively short gear train. The novel gear train of the present invention eliminates precise parts and reduces the costs involved with manufacturing the printer. In addition, the novel gear train does not appreciably reduce throughput.

Figure 4:
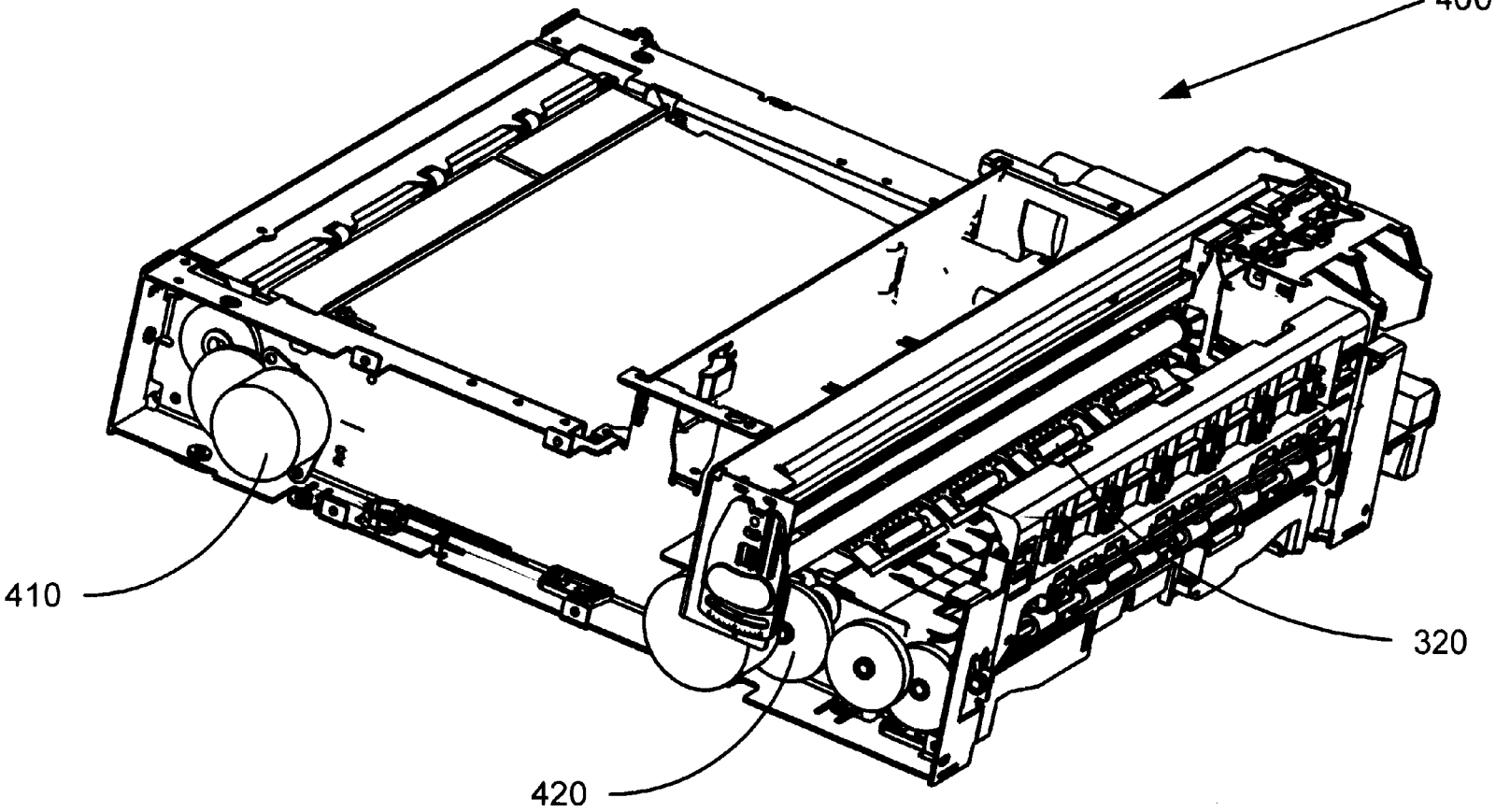
FIG. 4 depicts a print mechanism used in the present invention.

Namely, one aspect of the present invention is that each set of rollers 310, 320 is driven by its own motor rather than having both sets of rollers 310, 320 share one motor. For instance, FIG. 4 depicts a portion of the printer in the form of a print mechanism 400 used in accordance with the present invention. Shown in FIG. 4 are pick roller motor 410 and feed roller motor 420. Pick roller motor 410 is used to drive pick rollers 410 and feed roller motor 420 is used to drive feed rollers 420. The two motors 410 and 420 preferably operate independently of each other.

This arrangement solves the problems associated with a long media path described above. For example, a gear train for a motor driving a set of rollers can be greatly simplified with the arrangement of the present invention since the motor can be placed near the set of rollers that it drives. This minimizes the number of gears that needs to be used to drive a set of rollers. As such, the number of gears used can be reduced to two or three. For example, in a two gear arrangement, one gear can be for the motor and another gear can be for the set of rollers that the motor drives. This low number of gears avoids the need to use high precision gears in the gear train. Hence, the cost of the printer can be kept to a minimum.

Specifically, referring to FIG. 4 along with FIGS. 2–3, to engage the pick rollers 310 to pick print media 226 from the input tray 220, the pick motor 410 driving the pick rollers 310 can be run in reverse. This allows a quarter turn in reverse of the pick rollers 310 before normal operation is resumed. This method of engaging the pick rollers 310 to pick print media 226 from an input tray is well known in the industry and thus is not disclosed here. With a single motor system, because of the reverse operation of the motor and because the motor drives both the pick and the feed rollers, a two-roller printer could have problems picking up the print media until a present print media had first cleared the feed rollers. This could introduce printing alignment errors. Printing alignment errors include over printing as well as different spacing between printed lines.

Consequently, the set of pick rollers 310 is preferably driven by a different motor, the pick motor 410, than the set of feed rollers 320, which is driven by feed motor 420. In operation, as soon as the print media 226 clears the pick rollers 310, the pick rollers 310 can be engaged by running the pick motor 410 by a quarter turn to pick up the next print media from the input tray 220 without any adverse effects. In this case, portions of multiple print media can be in the media path 330 at the same time (this occurs when a succeeding print media is picked up right after a preceding print media has cleared the pick rollers 310). This technique enhances the throughput of the printer 104.

Figure 5:
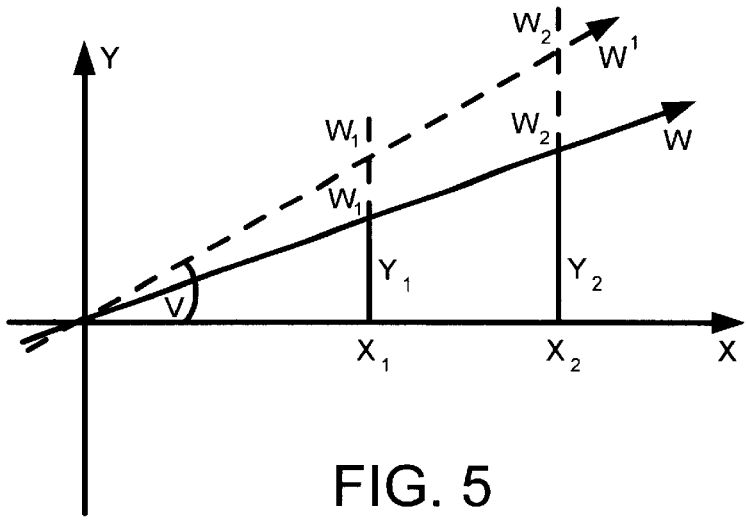
FIG. 5 depicts a right triangle illustrating the dependency of the margins on the angle at which the print media is picked up by the pick roller and the length of the paper path.

FIG. 5 depicts in general a right triangle illustrating the dependency of print margins on an angle at which the print media is picked up by the pick roller and the length of the paper path. Referring to FIG. 5 along with FIGS. 2–4, the x-axis of FIG. 5 represents the ideal direction of movement of the print media 226. The angle is the amount of skewness of the print media 226. The w-axis is the direction of movement of a skewed print media and the y-axis is the amount of offset of the margins of the print media 226. When the angle is zero (i.e., print media is not skewed), the print media 226 will travel along the x-axis. When the print media reaches either $x_1$ or $x_2$, $y_1$ or $y_2$ the angle will be equal to zero (i.e., the margins will not be offset).

When the angle is greater than zero, the print media 226 will travel along the w-axis. When the print media 226 reaches $w_1$, the print media 226 will be at $y_1$ distance away from the x-axis, and when the print media 226 reaches $w_2$, the print media 226 will be at $y_2$ distance away from the x-axis. Consequently, if the print zone is located at $x_1$ and the pick roller is at the origin of the x, y plane, print media picked up at an angle v will be offset by an amount $y_1$ when it reaches $w_1$. If, alternatively, the print zone is at $x_2$, the skewed print media will be offset by an amount $y_2$ when it reaches the print zone. As can be seen from FIG. 5, $y_2$ is a greater in magnitude than $y_1$. Hence, as the distance between the pick roller and the print zone increases (i.e., the longer the paper path), the offset of the margins of a skewed print media increases. It should be noted that a wider angle would yield a grater $y_1$ and $y_2$ (see dotted lines in FIG. 5).

For print media skew problems, the length of the media path 330 can be configured such that the distance between the pick rollers 310 and the feed rollers 320 is shorter than the length of the print media 226. Each set of rollers 310, 320 can include the roller itself, which is driven by the motor, and a pinch roller (not shown). The pinch roller is used to nip the print media and to propel the print media when the roller is turning. This can be accomplished with a pinch roller that presses tightly against the roller with which it is associated. The location where the pinch roller meets either the pick roller or the feed roller is commonly called a nip.

In the present invention, the feed roller motor is activated after a print media has reached the feed rollers 320. Thus, when the leading edge of the print media 226 reaches the nip of the feed rollers 320, the leading edge will be stopped from progressing forward. Nonetheless, the pick rollers 310 will continue to turn pushing the print media along. Stopping the leading edge of the print media 226 while pushing the back edge of the print media 226 forces the print media 226 to be bent into an arch. As the print media 226 is being arched, if the print media 226 was skewed, the leading edge of the print media 226 will be straightened out. Thus, when the feed rollers 320 start to turn, a straightened print media will be propelled toward the print zone. In this case, it should be noted that although the margins of the print media may be off slightly, information would not be printed on the print media in a slanted fashion.

Figure 6:
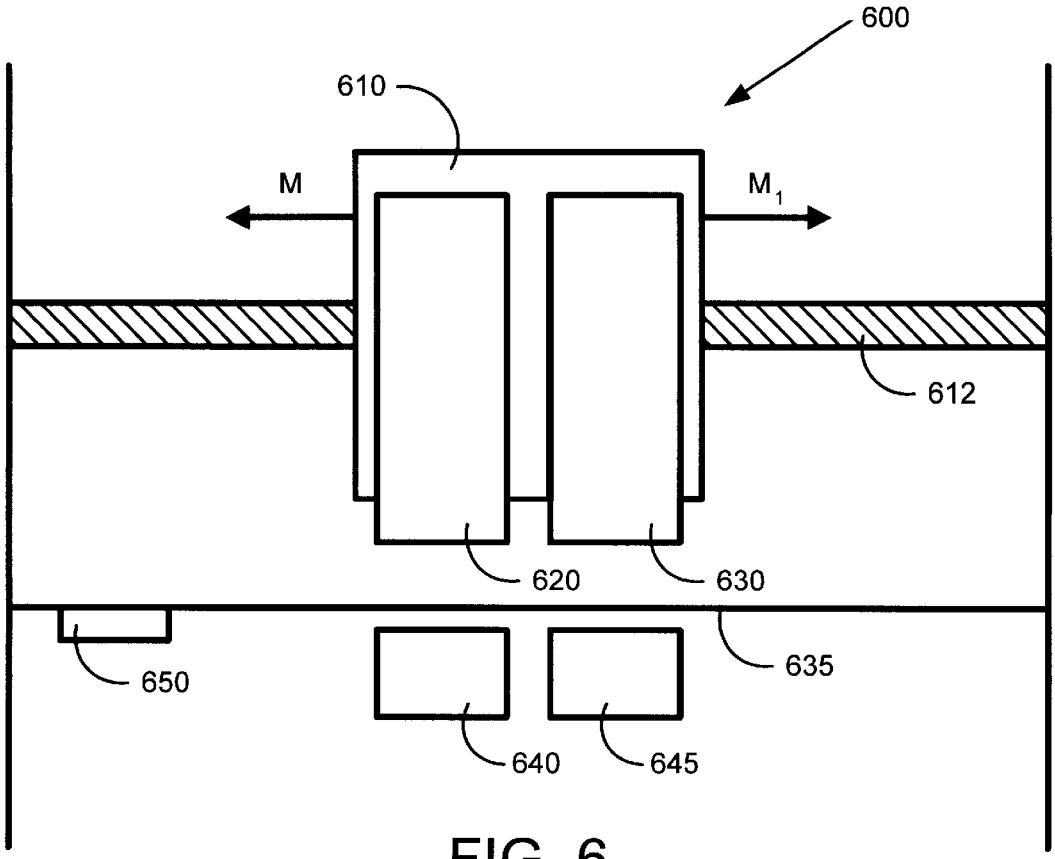
FIG. 6 illustrates a cross-sectional view of a print engine of the printer of the present invention.

FIG. 6 illustrates a cross-sectional view of a print engine of the living room printer 104 of the present invention. The print engine includes an ink jet printhead system 600 which preferably comprises a carriage 610 that contains multiple printheads or print cartridges 620 and 630. One of the print cartridges can be a color ink cartridge and the other can be a black ink cartridge. Note that it is possible to use only the color cartridge to print in either black and white or in color.

As such, the printer 104 of FIG. 1 of the present invention can use either a single color ink cartridge, interchangeable color and black ink cartridges or dual black and color ink cartridges.

The printer carriage 610 is preferably mounted on a slider rod 612 to carry ink cartridges 620 and 630 in the direction indicated by arrows M and $M_1$. This direction is perpendicular to the direction of movement of the print media. Travel of the carriage along the slider rod 612 is controlled in a conventional manner by a carriage drive motor (not shown).

Also, the ink jet printhead system 600 preferably contains three primary components, which are generally organized in series. These components are a platen 635, spittoons 640, 645, and a service station 650. The platen 635 has a printing area or print zone where the print media are printed upon by the ink jet printhead system 600. FIG. 6 shows the service station 650 and spittoons 640 and 645. The spittoons 640, 645 are receptacles in which excess print drops are disposed. The service station 650 preferably contains two capping stations and two wiper stations (not shown), one for each printhead. Spittoon 640 is used by printhead 620 and spittoon 645 is used by printhead 630. Service stations are described in general in co-pending U.S. patent application Ser. No. 09/115,153 entitled PRINTHEAD SERVICING TECHNIQUE, filed on Jul. 14, 1998 by Gaarder, the disclosure of which is hereby incorporated by reference.

In general, the ink jet printhead is wiped clean during use at the wiper station, and the ink jet printhead is capped to prevent it from drying out during periods of non-use at the capping station. To wipe the ink jet printhead, the wiper station is moved up above the surface of the platen to meet the ink jet printhead. Likewise, to cap the ink jet printhead the capping station is moved above the surface of the platen to meet the ink jet printhead. The feed roller motor 520 can be used to move the capping and wiper stations up and down. Consequently, an additional motor is not necessary.

Referring back to FIGS. 1–5 along with FIG. 6, as in the case of turning the pick motor 510 in reverse to engage the pick mechanism of the pick rollers 310, as described above, the feed motor 520 driving the feed rollers 320 can also be run in reverse to engage the wiper and capping stations of the service station 650. Wiping the ink jet printheads 620, 630 can occur between printed pages and capping the ink jet printheads 620, 630 can occur when the printer 104 is not in use.

Also, because the feed motor 520 driving the feed rollers 320 and the service station 650 is different from the pick motor 510 driving the pick rollers 310, new print media may be picked up by the print mechanism 400 while the ink jet printheads 620, 630 are being serviced without any adverse effects. Thus, throughput can be increased by picking up a print media while the ink jet printheads 620, 630 are being serviced as well as by having two print media partially in the media path at one time.

In addition, the printer 104 of the present invention can be configured to notify a user when a print media is jammed in the printer 104. The notification can be aurally by emitting a sound, visually by a blinking light, digitally by software notification indicated on a computer display, or by any other suitable means. In the present invention, two sensors are preferably used to detect the paper jams. The sensors are identical and are located in the paper path 330. One is located near the pick rollers 310 and the other is located near the feed rollers 320. Using these sensors to detect paper jams is well known in the industry and therefore their implementation is not disclosed.

To be able to locate exactly where a paper jam occurs, the present invention includes motor counts as well as the sensors. Namely, each revolution of the pick roller motor and the feed roller motor has a certain number of motor counts. As such, when a print media is picked up by the pick rollers 310, if the leading edge of the print media is not detected by the sensor closest to the pick rollers 310 after a first number of pick roller motor counts, then it is assumed that a paper jam occurs at the entrance of the paper path 330. Hence, the pick roller motor is run in reverse to clear the paper jam. The print media is then redeposited in the input tray 220 and the user is notified. The user may then either remove the print media if it is damaged or leave it in the input tray 220.

After the leading edge of the print media is detected by the sensor closest to the pick rollers 310, if the leading edge of the print media is not detected by the sensor closest to the feed roller after a second number of pick roller motor counts, then it is assumed that there is paper jam in the paper path 330. When this occurs, the pick roller motor is again run in reverse to clear the paper jam and the user is notified.

If the print media does not clear the sensor closest to the feed rollers 320 after a certain number of feed roller motor counts, it is then assumed that the print media is jammed and the user is notified. In this case, to clear the paper jam, the user is required to pull the print media from the front of the printer. In all cases, when a paper jam is detected, before notifying the user, power is cut off from the motor to avoid damage to the pick roller motor and the feed roller motor. This is because the user may have to pull the print media from either the pick rollers 310 or the feed rollers 320.

The description of the present invention has been presented for purposes of illustration and description, but is not intended to be exhaustive or limited to the invention in the form disclosed. Many modifications and variations will be apparent to those of ordinary skill in the art. For example, the printer need not be an ink jet printer. Therefore, the foregoing description should not be taken as limiting the scope of the invention defined by the appended claims.

What is claimed is:

1. A printer having at least one printhead for printing on print media and a removable input tray for holding the print media comprising:

a pick roller;

a feed roller, wherein the pick roller moves the print media from the input tray to the feed roller, and the feed roller moves the print media to a print zone where the print media are printed upon by the at least one printhead;

a motor assembly including a feed motor that drives the feed roller and a pick motor that drives the pick roller; and a service station that services at least one printhead, wherein the motor operating the feed roller is also used by the service station.

2. The printer of claim 1 wherein two gears are used to drive the pick roller and the feed roller.

3. The printer of claim 2 wherein the motor operating the feed roller is also used by a service station, wherein the service station services the at least one printhead.

4. The printer of claim 1 further comprising at least one sensor to detect paper jams.

5. The printer of claim 4 wherein when a paper jam is detected the pick motor automatically runs in reverse to clear the paper jam.

6. The printer of claim 5 wherein one print media is picked up by the pick roller while another print media is being printed upon by the at least one printhead.

7. The printer of claim 5 wherein one print media is picked up by the pick roller while the at least one printhead is being serviced.

8. The printer of claim 6 wherein the feed motor is actuated after the pick motor is actuated.

9. The printer of claim 8 wherein skewed print media are straightened out.

10. The printer of claim 8 wherein skewed print media is straightened out with an arrangement having the feed roller at a distance from the pick roller, the distance being shorter than the print media such that when a print media is forwarded from the pick roller to the feed roller, before the feed roller is actuated, an arch is formed by the print media paper allowing the print media to straighten out at the feed roller.

11. A method of straightening a skewed print media comprising:

placing a feed roller at a distance away from a pick roller, the pick roller for picking up print media from an input tray and to forward the print media to a feed roller, the feed roller for forwarding the print media to a print zone where the print media is printed upon by a printhead;

actuating a first motor to drive the pick roller;

actuating a second motor to drive the feed roller, the second motor being actuated after the print media has reached the feed roller thereby forcing the print media to arch and to straighten out at the feed roller; and servicing at least one printhead with a service station, wherein the second motor operating the feed roller is also used by the service station.

12. The method of claim 11, further comprising increasing printed media throughput when the printer is printing a multi-page document by picking up a succeeding print media while a preceding print media is being printed upon by a printhead.

13. The method of claim 12 further comprising the step of picking up a print media while the printhead is being serviced.

14. The method of claim 13 wherein the pick roller is used to pick print media from an input tray and to forward the print media to the feed roller, the feed roller being used to forward print media to the print zone where the print media is printed upon by the printhead, the feed roller being driven by a first motor and the pick roller being driven by a second motor, the first motor being different from the second motor.

15. The method of claim 14 further comprising using two gears to drive the feed roller and the pick roller.

16. The method of claim 15 further comprising using two sensors to locate paper jams.

17. The method of claim 16 further comprising locating a first sensor near the pick roller and locating a second sensor near the feed roller.

18. The method of claim 17 wherein if the paper jam is detected by the sensor located by the pick roller, running the motor driving the pick roller in reverse to clear the paper jam.

19. The method of claim 18 further comprising sending a notification signal when a paper jam is detected.

20. The method of claim 19 wherein the notification signal is at least one of visible, aural or software implemented.

* * * * *